US007140513B2

(12) United States Patent
Welchel et al.

(10) Patent No.: US 7,140,513 B2
(45) Date of Patent: Nov. 28, 2006

(54) CONVERTIBLE DISPENSER FOR SHEET MATERIAL

(75) Inventors: Debra N. Welchel, Woodstock, GA (US); Herb F. Velazquez, Neenah, WI (US); Joseph Mitchell, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/743,844

(22) Filed: Dec. 22, 2003

(65) Prior Publication Data

US 2005/0178781 A1 Aug. 18, 2005

(51) Int. Cl.
*B65H 1/00* (2006.01)

(52) U.S. Cl. ..... 221/45; 221/199; 221/283

(58) Field of Classification Search ..... 221/45, 221/47, 48, 63, 199, 282, 283, 286, 306; 206/233; 242/570, 571, 598
See application file for complete search history.

(56) References Cited

U.S. PATENT DOCUMENTS

| | | | | | |
|---|---|---|---|---|---|
| 1,683,641 | A | * | 9/1928 | Whitney | 221/45 |
| 1,910,094 | A | * | 5/1933 | Crane et al. | 221/45 |
| 1,977,687 | A | * | 10/1934 | Medoff | 206/494 |
| 2,000,454 | A | * | 5/1935 | Peters | 221/45 |
| 2,023,542 | A | * | 12/1935 | Peck | 221/45 |
| 2,122,048 | A | * | 6/1938 | Shapiro | 206/494 |
| 2,216,324 | A | * | 10/1940 | Ringler | 221/45 |
| 2,279,658 | A | * | 4/1942 | Crebbs | 221/45 |
| 2,287,581 | A | * | 6/1942 | Walker | 248/694 |
| 2,619,226 | A | * | 11/1952 | Adams | 221/63 |
| 2,765,909 | A | | 10/1956 | Graham | |
| RE24,906 | E | | 12/1960 | Ulrich | |
| 3,301,746 | A | | 1/1967 | Sanford et al. | |
| 3,322,617 | A | | 5/1967 | Osborne | |
| 3,612,264 | A | | 10/1971 | Trunick | |
| 3,824,953 | A | | 7/1974 | Boone | |
| 3,836,044 | A | | 9/1974 | Tilp et al. | |
| 3,837,595 | A | | 9/1974 | Boone | |
| 3,857,731 | A | | 12/1974 | Merrill, Jr. et al. | |
| 3,921,802 | A | | 11/1975 | Thompson | |
| 3,986,479 | A | | 10/1976 | Bonk | |
| 3,995,582 | A | | 12/1976 | Douglas | |
| 4,106,616 | A | | 8/1978 | Boone | |
| 4,106,617 | A | | 8/1978 | Boone | |
| 4,190,321 | A | | 2/1980 | Dorer et al. | |
| 4,235,333 | A | | 11/1980 | Boone | |
| 4,610,357 | A | | 9/1986 | Nakamura | |
| 4,620,502 | A | | 11/1986 | Kimble | |

(Continued)

FOREIGN PATENT DOCUMENTS

| | | |
|---|---|---|
| CA | 2305110 | 10/2001 |

(Continued)

*Primary Examiner*—David H. Bollinger
(74) *Attorney, Agent, or Firm*—Sue C. Watson

(57) ABSTRACT

A dispenser is provided which is adapted for dispensing from a table top and it is convertible to dispense from a conventional rolled product fixture. The dispenser includes a housing having a compartment configured to hold sheets. The housing also has a dispensing opening. The housing is configured to be positioned on a table top for dispensing sheets therefrom, and the housing includes a hanging port which permits the housing to be coupled to a conventional rolled product fixture. The hanging port is masked when the dispenser is positioned for dispensing from a table top. The hanging port is easily unmasked and configured to releasably couple the housing to a fixture in a bathroom for dispensing sheets therefrom.

25 Claims, 11 Drawing Sheets

U.S. PATENT DOCUMENTS

| | | | | |
|---|---|---|---|---|
| 4,638,921 | A | | 1/1987 | Sigl et al. |
| 4,651,874 | A | | 3/1987 | Nakamura |
| 4,653,250 | A | | 3/1987 | Nakamura |
| 4,739,879 | A | | 4/1988 | Nakamura |
| 4,741,944 | A | | 5/1988 | Jackson et al. |
| 4,834,316 | A | | 5/1989 | DeLorean |
| 4,865,221 | A | | 9/1989 | Jackson et al. |
| 4,913,312 | A | | 4/1990 | Boutin |
| 5,048,589 | A | | 9/1991 | Cook et al. |
| 5,194,299 | A | | 3/1993 | Fry |
| 5,265,758 | A | | 11/1993 | Saint Criq et al. |
| 5,311,986 | A | | 5/1994 | Putz |
| 5,399,412 | A | | 3/1995 | Sudall et al. |
| 5,409,181 | A | | 4/1995 | Patrick |
| 5,439,521 | A | | 8/1995 | Rao |
| 5,607,551 | A | | 3/1997 | Farrington et al. |
| 5,618,008 | A | | 4/1997 | Dearwester et al. |
| 5,620,148 | A | | 4/1997 | Mitchell |
| 5,629,081 | A | | 5/1997 | Richards et al. |
| 5,656,361 | A | | 8/1997 | Vogt et al. |
| 5,660,636 | A | | 8/1997 | Shangold et al. |
| 5,672,248 | A | | 9/1997 | Wendt et al. |
| 5,765,717 | A | | 6/1998 | Gottselig |
| 5,897,074 | A | | 4/1999 | Marino |
| 5,906,278 | A | * | 5/1999 | Ponsi et al. ..... 206/494 |
| 5,950,960 | A | | 9/1999 | Marino |
| 5,951,762 | A | | 9/1999 | Shangold et al. |
| 5,964,351 | A | | 10/1999 | Zander |
| 6,047,920 | A | | 4/2000 | Dearwester et al. |
| 6,056,235 | A | | 5/2000 | Brozinsky |
| 6,098,836 | A | | 8/2000 | Gottselig |
| 6,098,919 | A | | 8/2000 | Lewis |
| 6,170,698 | B1 | | 1/2001 | Phelps et al. |
| 6,230,929 | B1 | | 5/2001 | Phelps et al. |
| 6,328,252 | B1 | | 12/2001 | Neveu et al. |
| 6,346,153 | B1 | | 2/2002 | Lake et al. |
| 6,382,552 | B1 | | 5/2002 | Paul et al. |
| 6,439,384 | B1 | | 8/2002 | Martin |
| 6,439,386 | B1 | * | 8/2002 | Sauer et al. ..... 206/494 |
| 6,561,378 | B1 | * | 5/2003 | Roessler et al. ..... 221/45 |
| 6,588,626 | B1 | * | 7/2003 | Sauer et al. ..... 221/49 |
| 2002/0063136 | A1 | | 5/2002 | Sauer et al. |
| 2002/0092789 | A1 | | 7/2002 | Sauer et al. |
| 2003/0075551 | A1 | * | 4/2003 | Dailey, III ..... 221/45 |
| 2003/0192903 | A1 | | 10/2003 | Sauer et al. |

FOREIGN PATENT DOCUMENTS

| | | |
|---|---|---|
| EP | 0459110 | 12/1991 |
| EP | 0568987 | 7/1997 |
| EP | 1129656 A1 | 9/2001 |
| GB | 2270901 | 3/1994 |
| WO | WO 94/14365 | 7/1994 |
| WO | WO 98/04486 | 2/1998 |
| WO | WO 00/65973 | 11/2000 |
| WO | WO 01/76436 | 10/2001 |
| WO | WO 01/76439 | 10/2001 |
| WO | WO 01/76440 | 10/2001 |
| WO | WO 01/89935 | 11/2001 |
| WO | WO 02/21988 | 3/2002 |
| WO | WO 02/21989 | 3/2002 |

* cited by examiner

CONVERTIBLE DISPENSER FOR SHEET MATERIAL

BACKGROUND OF THE INVENTION

The use of single sheets provided as interfolded sheets for bath tissue has been widely accepted. Such single interfolded sheets often provide less waste than traditional rolled bath tissue. Similarly, the use of premoistened or "wet" sheets has gained wide acceptance for a variety of uses, particularly premoistened bathroom applications. The dry sheets and premoistened sheets are generally formed from an absorbent material such as a paper or a polymeric web, or combinations thereof, and may contain a disinfectant, medicant, deodorant, anti-microbial, anti-bacterial, cleansing agent, and so forth, in one or more combinations, on a dry sheet, or in a "wet" formulation on a premoistened sheet. Premoistened sheets are generally stored and dispensed from a sealable container to prevent the sheets from drying out.

Various dispenser designs for dry and/or premoistened sheets have been used with existing bathroom fixtures, such as fixtures for conventional rolled products. These separate or combined dispensers are often cumbersome and bulky, and they are problematic with regard to space and mounting considerations. Refilling one or both dispensers can also be difficult.

In addition, in a hospital or medical setting, rolls of toilet tissue are frequently disposed of after a patient leaves a hospital room. This is because toilet tissue in a roll has every edge of every sheet exposed; if contamination via liquid and/or particulate matter occurs, it could be passed on to the next patient. Such disposal results in a significant waste.

Accordingly, it would be desirable to provide a dispenser capable of dispensing dry and/or premoistened sheets, and so forth, from a table top. Such a dispenser would quickly and easily convert into a dispenser configured to couple to a conventional rolled product fixture and dispense sheets, such as toilet tissue, therefrom. Such a dispenser would also be desirable for use in a hospital room, where the outside of the dispenser may be easily cleaned and/or disinfected, and the dispenser acts to shield all but the exposed sheet extending therefrom. The dispenser would not need to be disposed of after a patient left, and only the exposed tissue would be removed to make the dispenser available for the next patient.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

As used herein, the term "contaminant" shall mean a chemical agent or biological organism/pathogen that can potentially harm a human being or animal.

As used herein, the term "particulate matter" refers to a substance formed of separate particles, i.e., one or more particles.

As used herein, the term "liquid" refers to any liquid, fluid, or mixture of gas and liquid; various types of aerosols and particulate matter may be entrained with such liquids.

These terms may be defined with additional language in the remaining portions of the specification.

SUMMARY OF THE INVENTION

In response to the difficulties and problems discussed above, a dispenser is provided which is adapted for dispensing from a table top and it is convertible to dispense from a conventional rolled product fixture. The dispenser includes a housing having a compartment configured to hold sheets. The housing also has a dispensing opening. The housing is configured to be positioned on a table top for dispensing sheets therefrom, and the housing includes a hanging port which permits the housing to be coupled to a conventional rolled product fixture. The hanging port is masked when the dispenser is positioned for dispensing from a table top. The hanging port is easily unmasked and configured to releasably couple the housing to a fixture in a bathroom for dispensing sheets therefrom.

DETAILED DESCRIPTION

Figure 1:
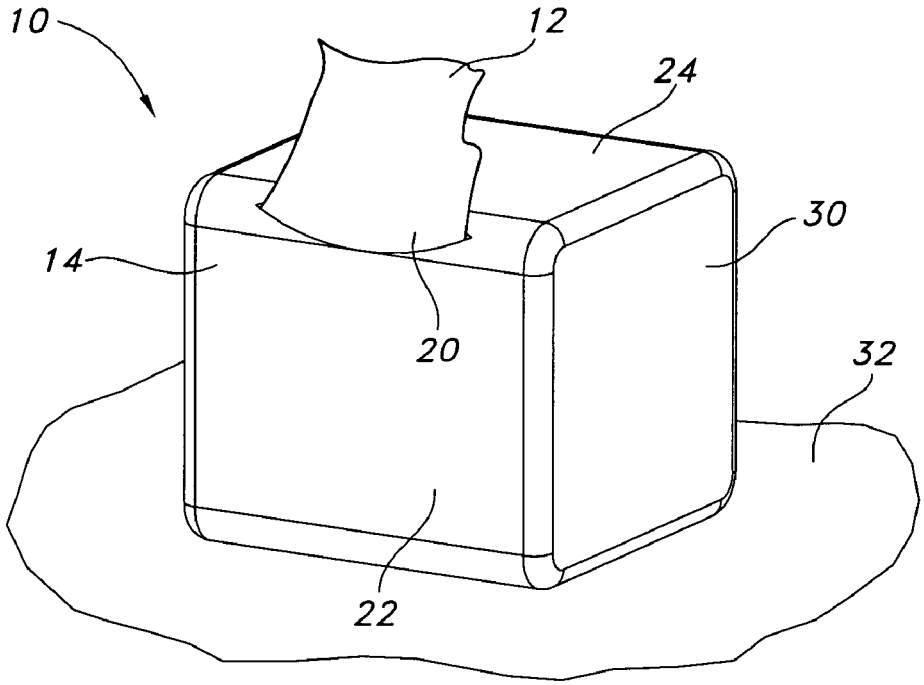
FIG. 1 is a perspective view of an embodiment of the dispenser of the present invention, showing the dispenser in its dispensing position on a substantially horizontal surface for dispensing dry sheets therefrom.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to the figures in general, a dispenser is provided for storing and dispensing sheets. It should be appreciated that the present invention is not limited to any particular type of sheets. The dispenser, however, is well suited for dispensing, by way of non-limiting example, festooned sheets, individual stacked sheets and/or interfolded sheets, as generally illustrated in the figures. Non-limiting examples of dry sheets are disclosed in U.S. Pat No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Non-limiting examples of premoistened sheets are disclosed in U.S. Pat. Nos. 4,741,944 and 4,865,221, both to Jackson et. al., U.S. Pat. No. 5,629,081 to Richards et al., U.S. Pat. No. 5,656,361 to Vogt et al., and U.S. Pat. No. 5,964,351 to Zander, all of which are incorporated by reference in there entirety herein. Such stack configurations for dry sheets, such as toilet tissue and/or premoistened sheets are well known to those of ordinary skill in the art and need not be described in great detail herein.

The dispenser shown in FIGS. 1–4 discloses a dispenser containing sheets. The dispenser may be used to dispense sheets from a table top for use as facial tissue sheets. The dispenser also has a hanging port which permits it to be releasably coupled to a conventional rolled product fixture; the dispenser extends downward therefrom to provide dry sheets for bath or toilet tissue. The dispenser shown in FIGS. 5–8 is similar to the previous dispenser, but dispenses premoistened sheets as well as dry sheets.

Turning now to FIGS. 1–4, a dispenser 10 according to the invention is provided for desirably, but not by way of limitation, dispensing dry sheets 12. In addition, the dry sheets 12 are desirably interfolded, stacked, and/or festooned, with or without perforations, and so forth.

The dispenser 10 includes a housing 14 which has a compartment 18 in which dry sheets 12 are stored and dispensed therefrom. A dispensing opening 20 is defined in the housing 14 to permit access to the compartment 18 (FIG. 4) and the dry sheets 12 therein. The dispensing opening 20 desirably is provided by way of non-limiting example at a junction of a front wall 22 and an upper end 24. One or more dispensing openings may be provided, however, in any wall, structure, and/or combination thereof in any embodiment herein of the housing to permit dispensing of any sheet(s) shown and/or described herein. It will be appreciated that the dispensing opening of any embodiment herein may take any suitable shape and configuration. Any dispensing opening shown and/or described herein may be covered, for example, but not by way of limitation, by a plastic film having a slit therein to provide access to the sheets (not shown), and so forth. In another alternative, the dispensing opening may be formed from perforated portions that, when removed, provide the opening (not shown), and so forth.

Figure 2:
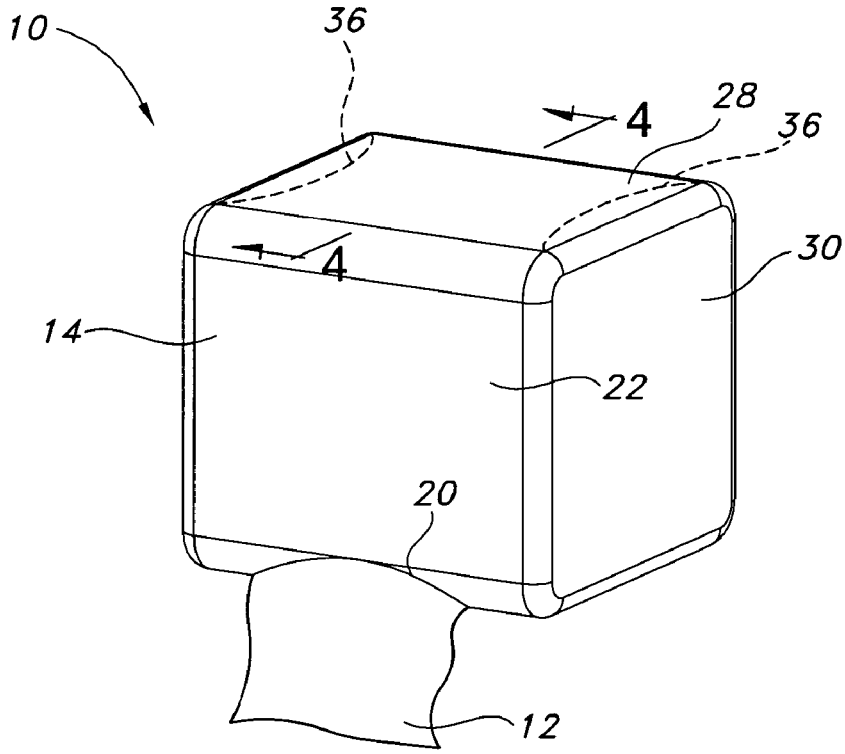
FIG. 2 is a perspective view of the dispenser of FIG. 1, but showing the dispenser positioned to open perforations before it is placed on a roll mount.

The housing 14 includes front and back walls 22, 26 (FIG. 4) and upper and lower ends 24, 28 (FIGS. 1 and 2). A pair of sidewalls 30 cooperate with the front and back walls 22, 26 and the upper and lower ends 24, 28 to provide the housing 14. Desirably, but not by way of limitation, the housing 14 may be formed to generally conform to a certain amount of dry sheets 12 provided in the housing 14. In the present embodiment, the dry sheets 12 as a group have a generally polygonal shape. Similarly, by way of non-limiting example, the housing 14 has a polygonal shape as well.

The dispenser 10 may be used to dispense dry sheets 12 from a generally horizontal surface 32 such as, for example, a table top, and so forth. When the dispenser 10 is positioned on such a horizontal surface 32, the structure, namely the wall or end having the dispensing opening 20 therein, such as the front wall 22 and upper end 24, is desirably disposed in a superior or higher position. Structures of the dispenser 10 which do not have a dispensing opening therein are desirably positioned in an inferior or lower position. As shown in FIG. 1, the front wall 22 and upper end 24 which have the dispensing opening 20 provided at the junction thereof may be positioned such that the dry sheets 12 may be easily withdrawn therefrom when the dispenser is positioned on the horizontal surface 32. It will be appreciated that any position may be used to dispense dry sheets 12, such as tissue sheets used as facial tissue, and so forth, from a horizontal surface 32 such as a table top. However, as often occurs in a bathroom, it is desirable to have a dispenser 10 which is suitable for dispensing dry sheets 12 for use as bath or toilet tissue. The dispenser 10 easily adapts to this task, converting from a table top dispenser to a dispenser which couples to a conventional rolled product fixture for dispensing sheets for use as bath or toilet tissue.

Figure 3:
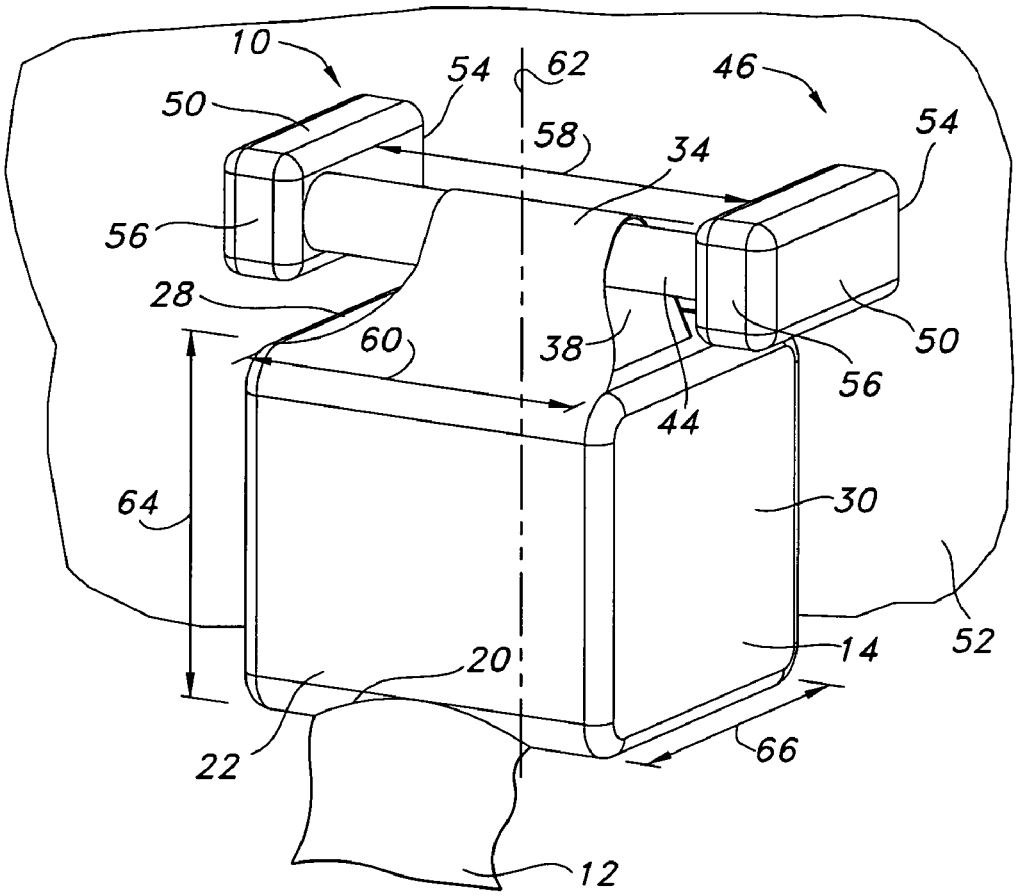
FIG. 3 is perspective view of the dispenser of FIG. 2, but showing the dispenser in its dispensing position for dispensing dry sheets when hung by its hanging port from a roll mount of a conventional rolled product fixture.
Figure 4:
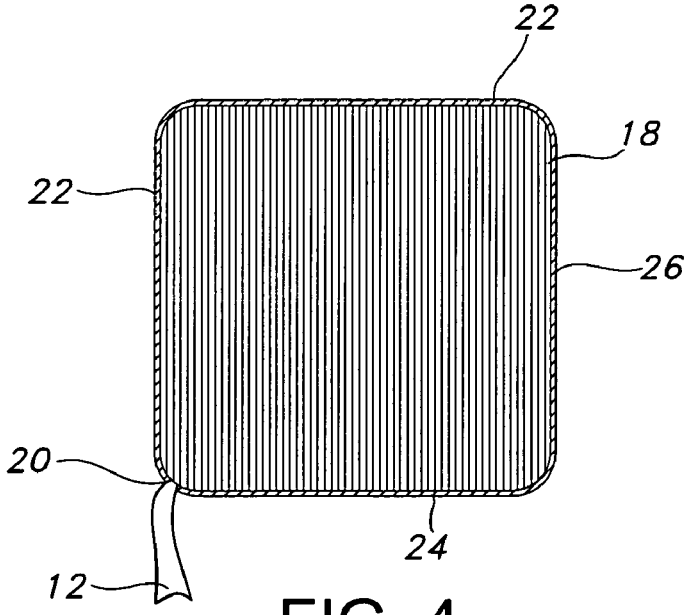
FIG. 4 is a sectional view of FIG. 2 taken along line 4—4.

As shown in FIGS. 2 and 3, the dispenser 10 desirably includes a hanging port 34 which is formed from, for example, but not by way of limitation, a portion of the lower end 28 of the housing 14. In this instance, a pair of perforations 36 which can be opened into a pair of openings 38 may be provided. Alternatively, slits (not shown) may be formed and covered by a seal or a release sheet (not shown). The housing 14, namely, the lower end 28, desirably provides adequate room for the introduction of a roll mount 44 therethrough, so that the dispenser 10 may be mounted on a conventional rolled product fixture 46. This design masks hanging port 34 and effectively hides the purpose of the hanging port 34 prior to its use. When the dispenser 10 is desired for use as a dispenser for toilet tissue, the perforations 36 are opened into openings 38 and the roll mount 44 of a conventional rolled product fixture 46 is disposed through the openings 38 so that the roll mount 44 and therefore the dispenser 10 may be coupled to the rolled product fixture 46.

The dispenser 10 shown in FIG. 1 is rotated in a direction and the roll mount 44 is positioned through the hanging port 34 as described in detail above, and the roll mount 44 is releasably coupled to the fixture 46, as illustrated in FIGS. 2 and 3. Such a fixture 46 has at least a pair of side support arms 50 mounted to and extending transversely from a generally vertical support surface 52. Alternatively, the support arms 50 are coupled to a base or back member (not shown). As shown in FIG. 3, each of the side support arms 50 extends from a coupled end 54 to a free end 56 of the side support arm 50, which often has a recess therein (not shown). In addition, the side support arms 50 have a width dimension 58 which extends between the side support arms 50. Typically, a roll mount 44 extends across this width dimension 58 to releasably couple to the side support arms 50. The roll mount 44 typically includes a protruding member on each end (not shown). The protruding member is desirably releasably positioned in the recess of the support arm 50 to suspend the roll mount 44 between the support arms 50. The roll mount 44 in the present embodiment, for example, is a conventional spindle. As used herein, the term "roll mount" includes a spindle, and also includes a pair of prongs mounted on each support arm in a confronting relationship, such that may be used with a coreless bath tissue roll, such as, by way of example and not limitation, the one illustrated and described in detail in U.S. Pat. No. 5,620,148 to J. Mitchell, which is hereby incorporated by reference in its entirety herein.

In the embodiments illustrated herein, the width dimension 58 between the side support arms 50 also provides a desired and aesthetic proportion for a width dimension 60 of the lower end 28 of the housing 14 and the hanging port 34. The width dimension 58 between the side support arms 50 is typically in a range of about 6.0 inches to about 4.0 inches.

Therefore, the width dimension 60 of the lower end 28 of the housing 14 is desirably in a range of about 5.5 inches to about 4.7 inches. Even more desirably, the width dimension 60 is in a range of about 5.25 inches to about 4.6 inches. Yet even more desirably, the width dimension 60 is in a range of about 5.25 inches to about 4.5 inches.

When the housing 14 is suspended from the roll mount 44 via the hanging port 34, the housing 14 extends therebelow. The hanging port 34 is desirably integrally provided with the housing 14 via a portion of the lower end 28. Alternatively, the hanging port 34 is provided separately and coupled to a portion of the lower end (not shown). The openings 38 may provide a visual guide to a user as to how many sheets 12 remain in the dispenser 10. Alternatively, the openings 38 may be covered by a clear or opaque material, such as, by way of non-limiting example, a plastic film, to protect the sheets 12 from exposure to any contaminant.

An axis 62 may be positioned vertically through the apex of the hanging port 34 and the roll mount 44; the axis 62 is also positioned substantially parallel to the generally vertical support surface 52. It will be appreciated, however, that the dispenser may be off-set relative to the vertical support surface 52, so that the axis 62 is not parallel to the vertical support surface 52, and the axis 62 extends at an oblique angle relative to the vertical support surface 52. Positioning of the dispenser 10 when it is coupled to the fixture 46 is based on the location of the dispensing opening 20 and the angle which provides easiest access to the dry sheets 12.

The housing 14 desirably has a length dimension 64 which extends from the upper end 24 to the lower end 28. The housing 14 also has a depth dimension 66 which extends from the front wall 22 to the back wall 26.

Any portion of any housing shown and/or described herein may include an additional opening which, if the housing is opaque, reveals the amount of tissue contained in the compartment (not shown). Such an opening provides an indication of whether there is sufficient tissue in the compartment, or whether a refill may be needed. It will be appreciated that when the housing is substantially clear or tinted, the dry sheets are visible to a user and no opening may be needed.

The housing 14 may desirably be non-refillable, and when the dry sheets 12 are removed, the dispenser 10 is disposed of. However, the housing may be refillable. If refillable, the housing will open along the junction of one of more wall or ends (not shown). At least a portion of the walls or ends may be connected by hinges, such as living hinges, fasteners, latches, and so forth, to permit access and closure to the compartment.

Any housing herein may be formed from any conventional material, such as, but not by way of limitation, metal, plastic, wood, fabric, fiber, and any combination thereof, and so forth. Any housing herein may also be provided from a relatively inexpensive cardboard, paper, paperboard, plastic, polymer film, cellophane, any combination thereof, and so forth. Any housing herein may be provided in any shape or configuration, and the present embodiments are provided as a non-limiting example thereof.

If the dispenser 10 permits refilling, a plurality of dry sheets 12 are disposed in the compartment 18 of the housing 14. In this instance, the dry sheets 12 may be provided in a cartridge of sheets (not shown). Such a cartridge is formed about at least a portion of the dry sheets to couple a plurality of dry sheets together. The cartridge may be a band, or may provide a housing (not shown). In this situation, an opening is provided in at least one surface of the cartridge which desirably aligns with a dispensing opening in the housing, to permit dispensing of the sheets therefrom.

Figure 6:
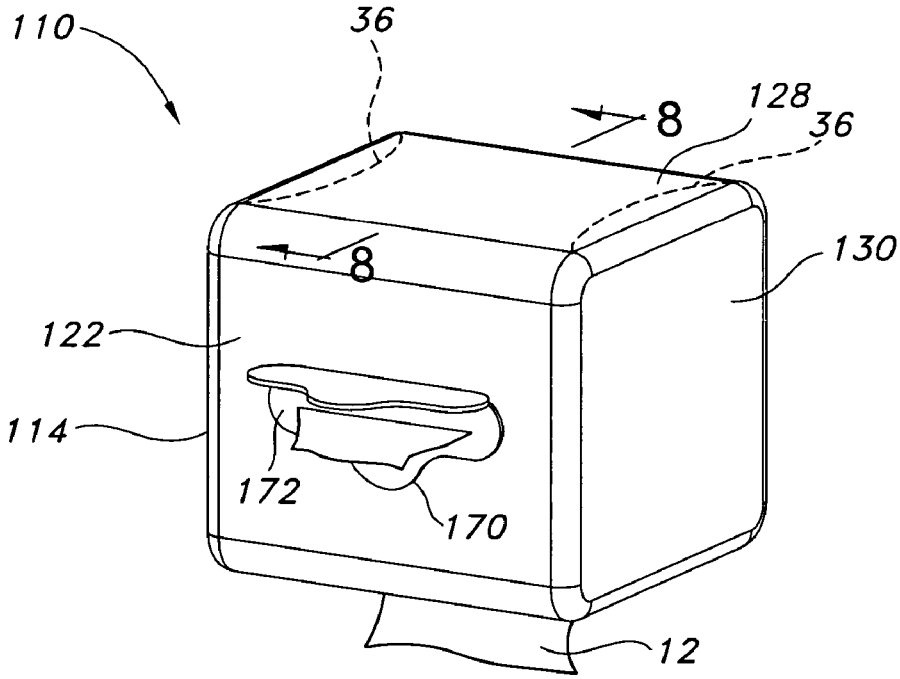
FIG. 6 is a perspective view of the dispenser of FIG. 5, but showing the dispenser positioned to open perforations before it is placed on a roll mount.
Figure 7:
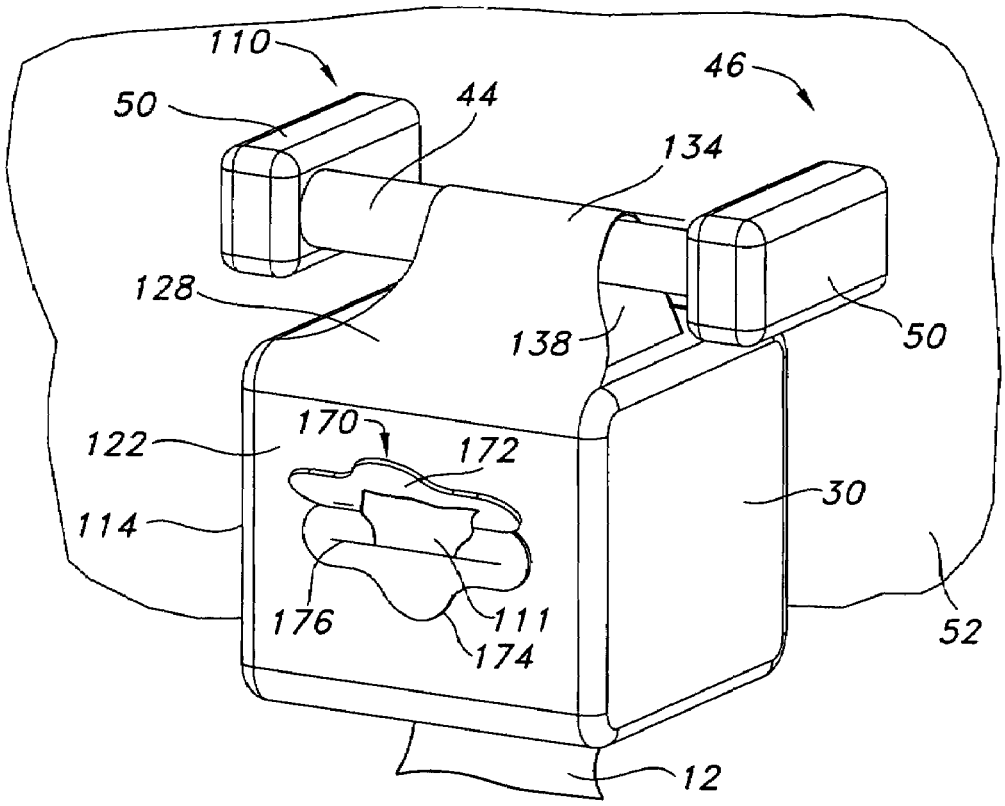
FIG. 7 is a perspective view of the dispenser of FIG. 6, but showing the dispenser in its dispensing position for dispensing dry sheets and premoistened sheets when hung by its hanging port from a roll mount of a conventional rolled product fixture.
Figure 8:
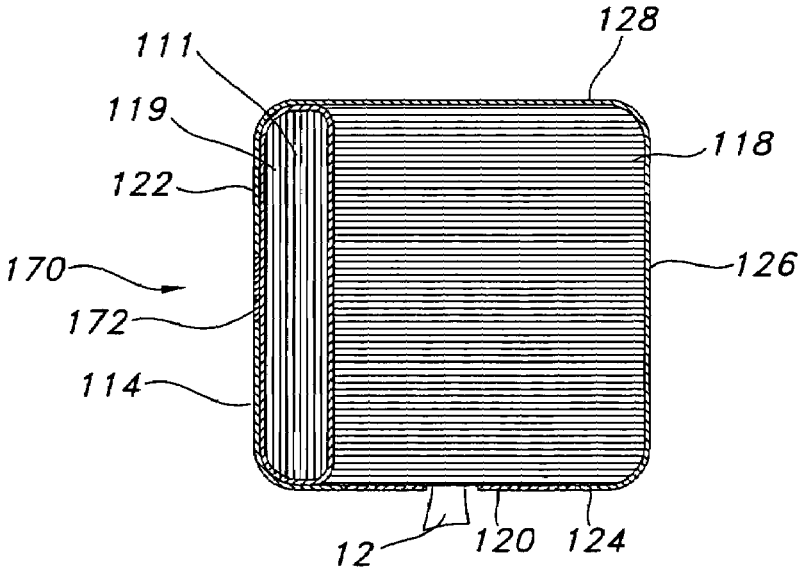
FIG. 8 is a sectional view of FIG. 6 taken along line 8—8.

In another embodiment of the invention, as illustrated in FIGS. 5–8, the dispenser 110 and housing 114 are very similar to the dispenser 10 and the housing 14 shown in FIGS. 1–4, and previously described in detail herein. The dispenser 110, however, is adapted to provide premoistened sheets 111 as well as dry sheets 12 from a single housing 114. The compartment 118 contains a plurality of dry sheets 12. The compartment 118 also includes a container 119 of premoistened sheets 111 as well. The container 119 of premoistened sheets 111, as illustrated in FIG. 8, may be provided as a separate container 119. Alternatively, however, the container 119 of premoistened sheets 111 may be provided as a portion of a cartridge which includes dry sheets 12 (not shown).

Figure 5:
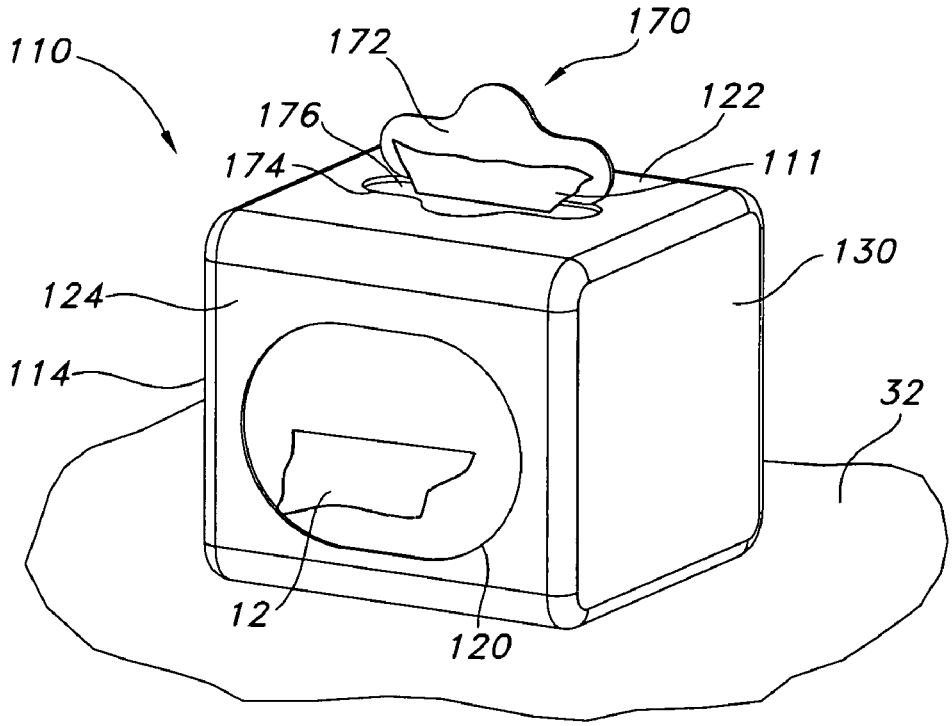
FIG. 5 is another embodiment of a dispenser of the present invention, showing the dispenser in its dispensing position on a substantially horizontal surface for dispensing either dry sheets or premoistened sheets therefrom.

The housing 110, similar to the housing 10, as shown in FIGS. 5–6 and 8 includes front and back walls 122, 126 (FIG. 8) and upper and lower ends 124, 128 (FIGS. 5 and 6). Sidewalls 130 cooperate with the front and back walls 122, 126 and upper and lower ends 124, 128 to provide closure to the housing 114. Desirably, but not by way of limitation, the housing 114 may be formed to generally conform to a certain amount of dry sheets 12 and premoistened sheets 111. In the present embodiment, by way of non-limting example, the dry sheets 12 and the container 119 of premoistened sheets 111 may together have a generally polygonal shape.

The premoistened sheets 111 are dispensed from the container 119 from openings (not shown) in the container 119 and through a dispensing opening (not shown) in the housing 114. The dry sheets 12 may be dispensed from the dispensing opening 120 in the upper end 124 of the housing 114, as illustrated in FIGS. 5 and 8. The premoistened sheets 111 may be dispensed from the front wall 122 of the dispenser 110 via a resealable cover 170. The dispenser 110 in this embodiment may be rotated such that the front wall 122 is positioned in a higher or more superior position relative to the upper end 124, which is positioned in a lower position or more inferior position.

As shown in FIGS. 5–8, the resealable cover 170 may be positioned over the dispensing opening (not shown) in the housing 114 which is aligned with the opening (not shown) in the container 119 of premoistened sheets 111. The premoistened sheets 111 are then accessed through a resealable cover 170 to permit dispensing of the premoistened sheets 111 from the dispenser 110. Alternatively, or, in addition thereto, the container 119 may also include a resealable cover which is aligned with the dispensing opening of the housing to permit access to the premoistened sheets 119 as well (not shown).

The resealable cover 170 is used to maintain the moisture conditions within the container 119 and to prevent undesired drying out of the premoistened sheets 111. In a non-limiting example of one possible resealable cover 170, FIGS. 5 and 7 disclose a resealabe cover 170 which includes an upper flap 172 which is coupled to a portion of a lower flap 174, which has an opening or slit 176 therein, through which the premoistened sheets 111 are withdrawn. The upper flap 172 releasably engages the lower flap 174 to provide a releasable closure to the housing 114 and the container 119. Such releasable and resealable features between the upper and lower flaps 172, 174 is provided, by way of non-limiting example, an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known and may be used; any resealable mechanism known in the art may be used with any dispensing opening in the housing and/or any opening in the container.

As illustrated in FIG. 8, the housing 114 desirably is an integral unit such that one compartment contains the dry sheets 12 and the container 119 of premoistened sheets 111. However, alternatively, the housing 114 may include first and second compartments formed separately such that one compartment holds dry sheets and another compartment holds the container of premoistened sheets (not shown). Such compartments may be delineated by separate cartridges or containers, or, by way of non-limiting example, the housing may have at least a portion of an inner wall (not shown) in which to provide first and second compartments (not shown). In another alternative, the two housings, one with dry sheets and one with premoistened sheets, may be coupled together via adhesive, hook and loop material, fasteners, or any mechanism known in the art.

The premoistened sheets 111 may be encased in a liquid impermeable film, and this film may provide a portion, or all, of the container 119 as shown in FIG. 8. In a further example, the container 119 may be formed from at least one other material, and the container 119 may be lined with the film (not shown).

When the dispenser 110 is used to dispense dry sheets 12 and premoistened sheets 111 from various generally horizontal surfaces 32 (FIG. 5), the dispenser 110 is positioned, for example, but not by way of limitation, such that, as discussed previously, the front wall 122 and the resealable cover 170 thereon from which the premoistened sheets 111 are dispensed is disposed in a superior or higher position. The dispensing opening 120 from which the dry sheets 12 are dispensed is positioned in an inferior or lower position. It will be appreciated that these positions may be reversed, with no detrimental effects to the dispenser 110, the premoistened sheets 111, or the dry sheets 12. Either of these positions permits dispensing of dry sheets 12 or premoistened sheets 111 for use, for example, as facial tissue sheets, wet wiping sheets, and so forth. However, when it is desired to use the dispenser 110 to dispense the dry sheets 12 and/or the premoistened sheets 111 for use as bath or toilet tissue, the dispenser 110 easily adapts to this task, converting from a table top dispenser to a dispenser which couples to a conventional rolled product fixture for dispensing sheets for use as bath or toilet tissue.

The dispenser 110, as shown in FIG. 6 and 7, has a hanging port 134 which is provided with a lower end 128 of the housing 114, as described previously herein. When the housing 114 is suspended from the roll mount 44, it is suspended in a manner which is identical to that described previously; therefore, it will be understood that the housing 114 may be suspended such that the axis 162 is parallel to the vertical support surface. Alternatively, the axis may be non-parallel, depending upon the angle desired for ease in dispensing both the dry sheets 12 and the premoistened sheets 111. That is, the axis 162 may extend at an oblique angle relative to the vertical support surface 52. In the present embodiment, when the dispenser 110 is turned in a direction 176 to be suspended from the roll mount 44 and fixture 46. In this position, the dry sheets 12 on the upper end 124 of the dispenser are desirably positioned in a lower, inferior position, relative to the premoistened sheet 111, which are desirably positioned in a superior or higher position.

The dispenser 110 and the housing 114 include width, length, and depth dimensions 60, 64, 66, respectively. These dimensions are the same as those previously described for dispenser 10 and housing 14 (FIG. 3). In addition, it will be appreciated that the dispenser 110 and the housing 114 may include any features and/or characteristics shown and/or described herein for any dispenser and housing.

It will be understood that the position of the premoistened sheets and/or the dry sheets within the housing of any embodiment of this invention may be reversed, and they need not be in a specific configuration, and may take on any suitable arrangement, including a stacked arrangement, a side-by-side arrangement, a coaxial arrangement, and so forth. Any number of configurations may be used for simultaneously dispensing dry and premoistened sheets from a single housing. All such configurations are within the scope and spirit of the present invention.

Turning now to two other embodiments of the invention, FIGS. 9–12 disclose a dispenser containing dry sheets. The dispenser may be used to dispense sheets from a table top for use as facial tissue sheets. The dispenser also has a hanging port which is formed from additional material which may be extended into an apex or point above the housing. The dispenser may be placed on a table top, or releasably coupled via the hanging port to a conventional rolled product fixture to provide dry sheets for bath or toilet tissue. The dispenser shown in FIGS. 13–16 is similar to the previous dispenser, but dispenses premoistened sheets as well as dry sheets.

Turning now to FIGS. 9–12, a dispenser 210 according to the invention is provided for desirably, but not by way of limitation, dispensing dry sheets 12. The dispenser 210 and housing 214 is similar to the dispenser 10 and housing 14 previously shown and described in detail herein.

The dispenser 210 includes a housing 214 which has a compartment 218 (FIG. 12) in which dry sheets 12 are stored and dispensed therefrom. A dispensing opening 220 is defined in the housing 214 to permit access to the compartment 218 and the dry sheets 12 therein. The dispensing opening 220 desirably is provided by way of non-limiting example in a front wall 222.

Figure 9:
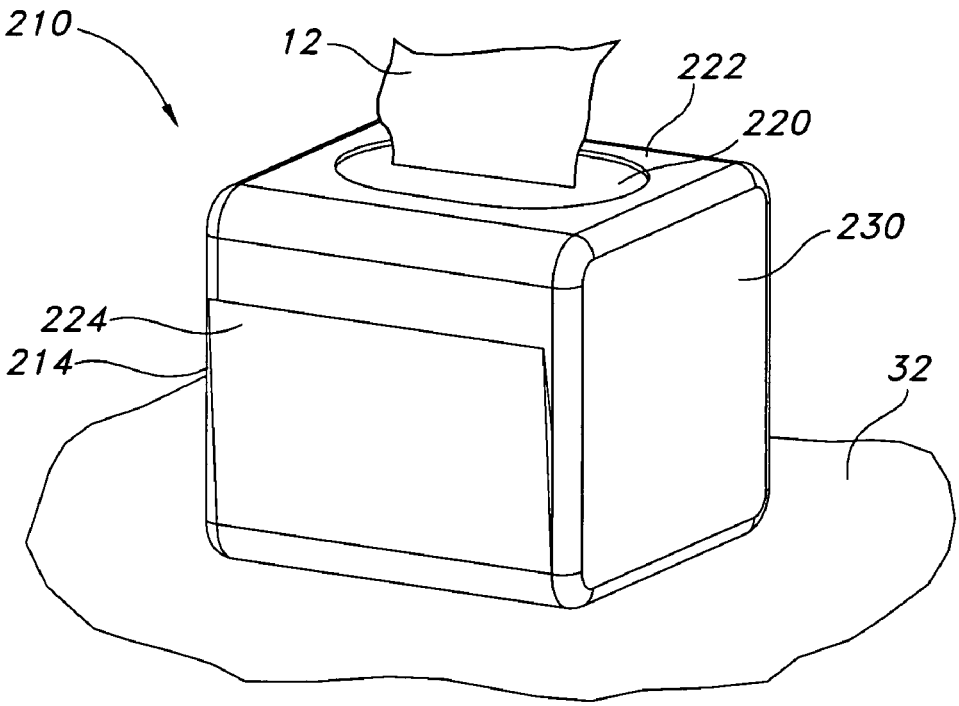
FIG. 9 is a perspective view of an yet another embodiment of the dispenser of the present invention, showing the dispenser in its dispensing position on a substantially horizontal surface for dispensing dry sheets therefrom.
Figure 10:
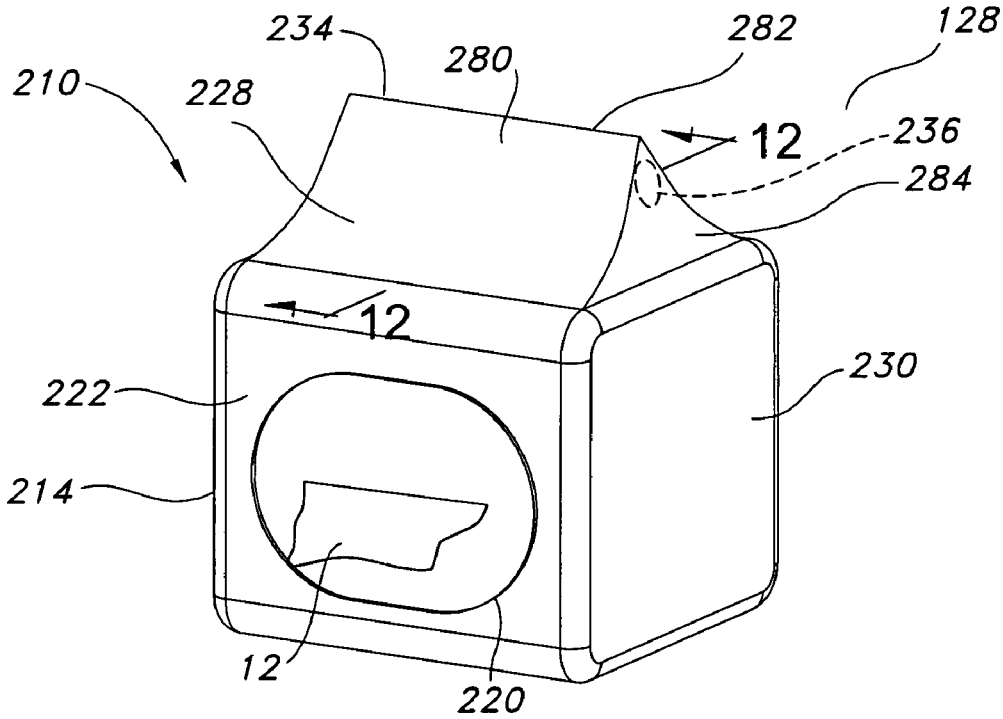
FIG. 10 is a perspective view of the dispenser of FIG. 9, but showing the dispenser positioned to open perforations before it is placed on a roll mount.

The housing 214 includes front and back walls 222, 226 (FIG. 12) and upper and lower ends 224, 228 (FIGS. 9 and 10). A pair of sidewalls 230 cooperate with the front and back walls 222, 226 and ends 224, 228 to provide the housing 214. Desirably, but not by way of limitation, the housing 214 may be formed to generally conform to a certain amount of dry sheets 12 provided in the housing 214, as described previously.

The dispenser 210 is used to dispense dry sheets 12 from a generally horizontal surface 32, such as, for example, a table top, and so forth. When the dispenser 210 is positioned on such a horizontal surface 32, the structure, namely the wall or end having the dispensing opening 220 therein, such as the front wall 222, is desirably disposed in a superior or higher position, as shown in FIG. 9. It will be appreciated, however, that any position may be used to dispense dry sheets 12, such as tissue sheets used as facial tissue, and so forth, from a horizontal surface 32 such as a table top. The present dispenser 210 also is suitable for dispensing dry sheets 12 for use as bath or toilet tissue, and easily adapts to this task, converting from a table top dispenser to a dispenser which couples to a conventional rolled product fixture for dispensing sheets for use as bath or toilet tissue.

Figure 11:
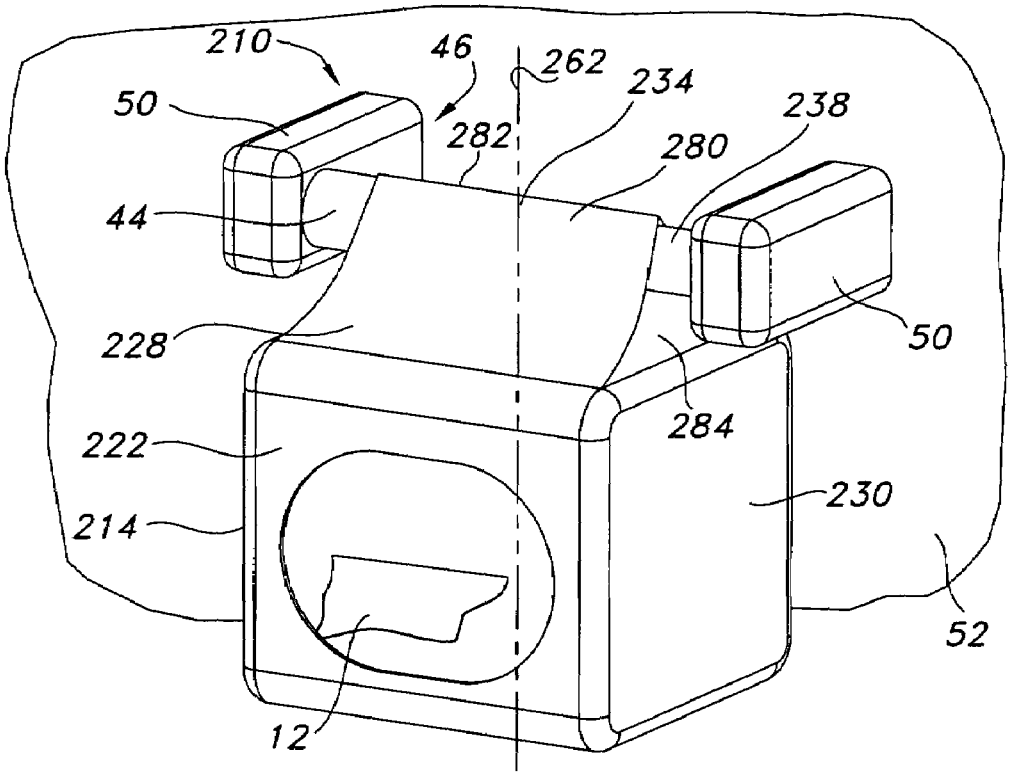
FIG. 11 is perspective view of the dispenser of FIG. 10, but showing the dispenser in its dispensing position for dispensing dry sheets when hung by its hanging port from a roll mount of a conventional rolled product fixture.
Figure 12:
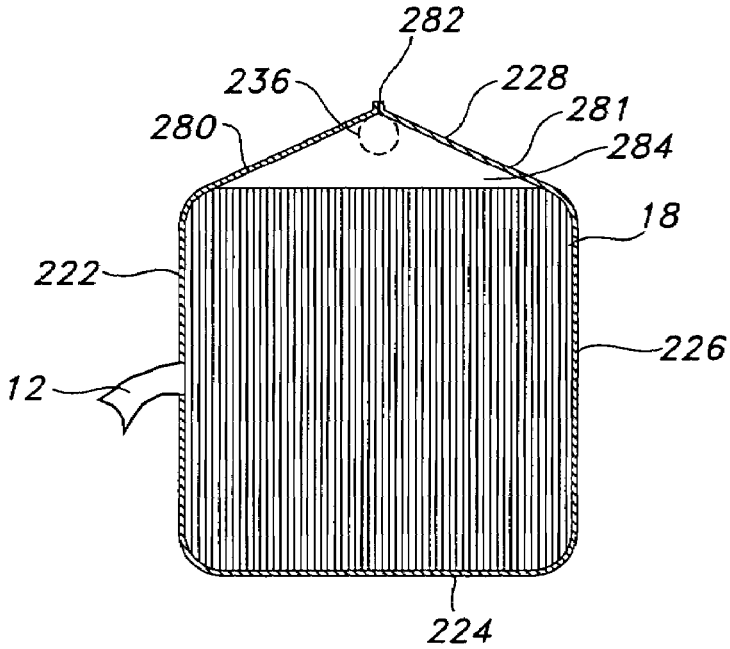
FIG. 12 is a sectional view of FIG. 10 taken along line 12—12.

As shown in FIGS. 10–12, the dispenser 210 desirably includes a hanging port 234. The hanging port 234 in the present embodiment has an excess of material on the portion of the housing 214, in this example, the lower end 228. When the excess of material is extended, it forms a tent-shaped configuration, such that when extended, two sides 280, 281 extends upward to a center apex 282 at an angle of greater than 90 degrees relative to the adjacent front and back walls 222 and 226. Two opposing generally triangular-shaped sides 284 adjacent the side walls 230 are also formed, when the excess material is extended. As shown in FIGS. 10 and 12, a pair of perforations 236 which can be opened into a pair of openings 238 (FIG. 11) may be provided. Alternatively openings may be provided which are covered by a seal or a release sheet (not shown).

The excess material of the housing 14 desirably provides adequate room for the introduction of a roll mount 44 through the openings 238, so that the dispenser 210 may be mounted on a conventional rolled product fixture 46. This design masks the hanging port 234 when it is in a collapsed, folded down and un-extended position and effectively hides the purpose of the hanging port 234 prior to its use. When the dispenser 10 is desired for use as a dispenser for toilet tissue, the perforations 236 are opened into openings 238 and the roll mount 44 is disposed therethrough to permit the dispenser 210 to be coupled to the rolled product fixture 46.

The dispenser 210 is rotated in a direction and the hanging port 234 is extended (FIGS. 10 and 12). The perforations 236 are opened and the roll mount 44 is positioned through the openings 238 in the hanging port 234 (FIG. 11) as described in detail above. The dispenser is provided in an aesthetic proportion relative to the fixture 46, and includes the width, length and depth dimensions 60, 64, 66 described previously herein.

It will be appreciated that when the housing 214 is suspended from the roll mount 44 via the hanging port 234, the housing 214 desirably, but not by way of limitation, extends therebelow. The hanging port 234 is desirably integrally provided with the housing 214. Alternatively, the hanging port 234 may be provided separately and coupled to a portion of the housing 214 (not shown).

An axis 262 may be positioned vertically through the apex 282 of the hanging port 34 and the roll mount 44; the axis 262 is also positioned substantially parallel to the generally vertical support surface 52. It will be appreciated, however, that the dispenser may be off-set relative to the vertical support surface 52, so that the axis 262 is not parallel to the vertical support surface 52, and extends at an oblique angle relative to the vertical support surface 52. The position of the dispenser 210 when it is coupled to the fixture 46 is based on the location of the dispensing opening 220 and the angle which provides easiest access to the dry sheets 12.

The housing 214 may desirably be non-refillable, and when the dry sheets 12 are removed, the dispenser 210 is disposed of. However, the housing may be refillable, as previously described herein. The dispenser 214 may be formed from any material(s) described herein, and contain any feature from any embodiment shown and/or described herein.

Figure 14:
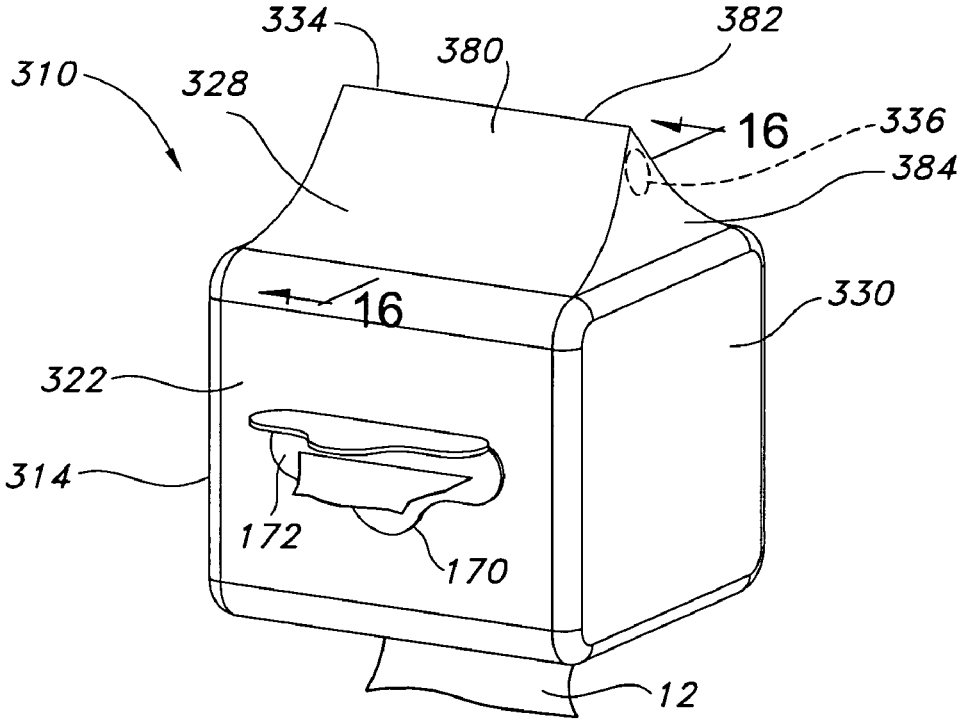
FIG. 14 is a perspective view of the dispenser of FIG. 13, but showing the dispenser positioned to open perforations before it is placed on a roll mount.
Figure 15:
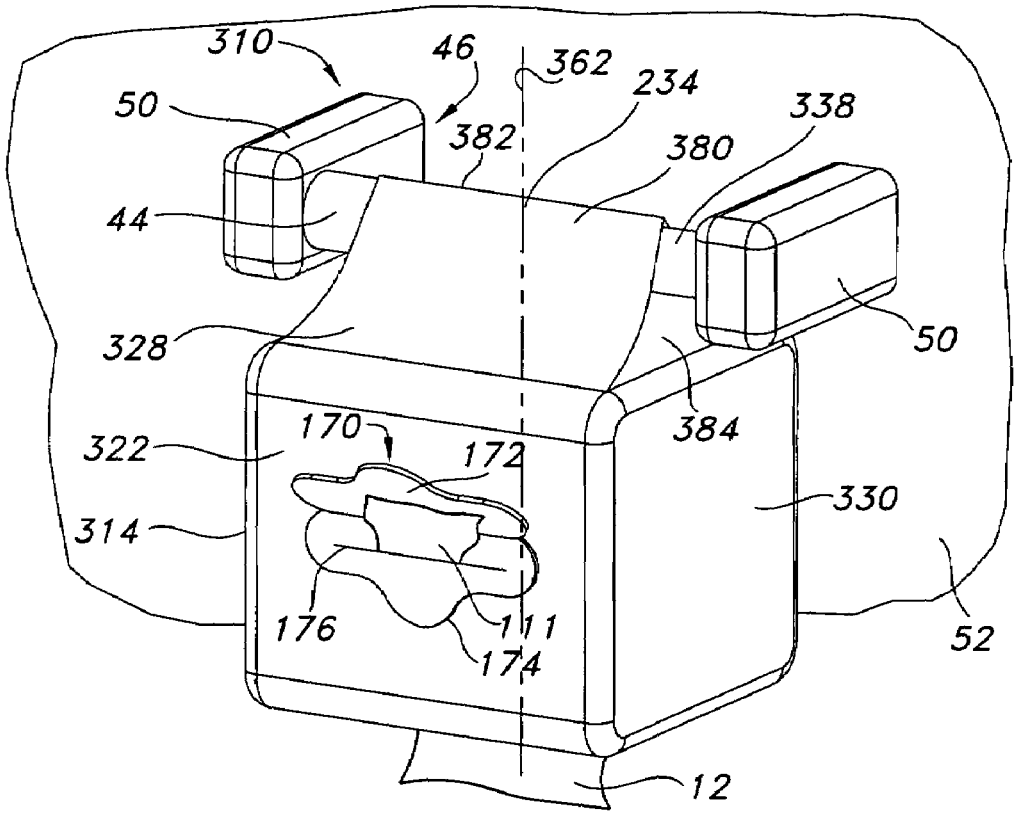
FIG. 15 is a perspective view of the dispenser of FIG. 14, but showing the dispenser in its dispensing position for dispensing dry sheets and premoistened sheets when hung by its hanging port from a roll mount of a conventional rolled product fixture.
Figure 16:
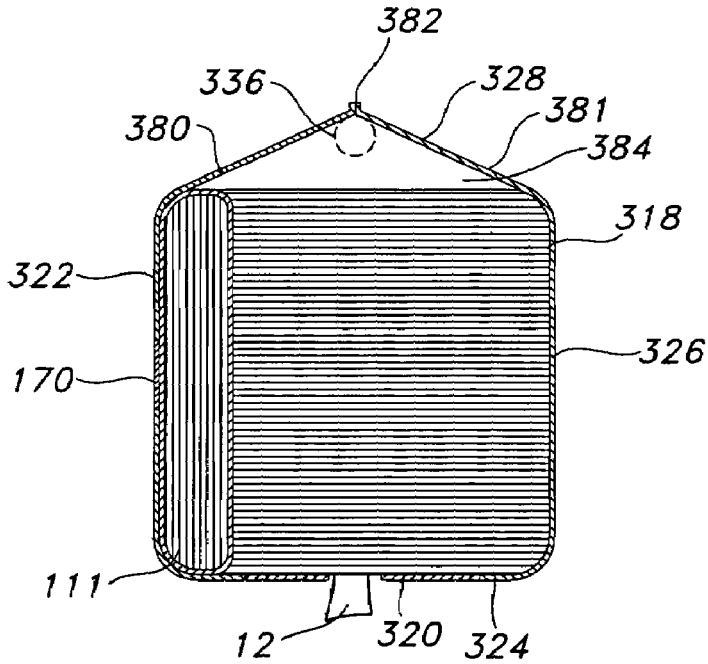
FIG. 16 is a sectional view of FIG. 14 taken along line 16—16.

In another embodiment of the invention, as illustrated in FIGS. 13–16, the dispenser 310 and housing 314 are very similar to the dispenser 210 and the housing 214 shown in FIGS. 9–12, and previously described in detail herein. The dispenser 310, however, is adapted to provide premoistened sheets 111 as well as dry sheets 12 from a single housing 314. The compartment 318 (FIG. 16) contains a plurality of dry sheets 12. The compartment 318 also includes a container 319 of premoistened sheets 111 as well. The container 319 of premoistened sheets 111, as illustrated in FIG. 16, may be provided as a separate container. Alternatively, however, the container 319 of premoistened sheets 111 may be provided as a portion of a cartridge which includes dry sheets 12 (not shown).

Figure 13:
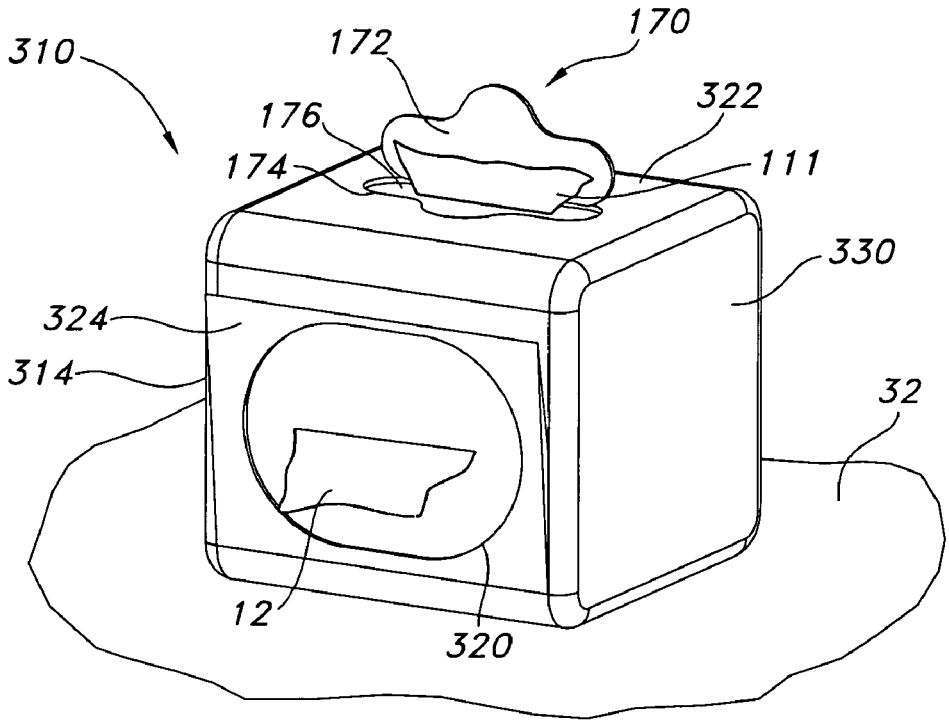
FIG. 13 is still yet another embodiment of a dispenser of the present invention, showing the dispenser in its dispensing position on a substantially horizontal surface for dispensing either dry sheets or premoistened sheets therefrom.

The housing 310, similar to the housing 210, includes, as shown in FIG. 13, 14 and 16, front and back walls 322, 326 and upper and lower ends 324, 328. Sidewalls 330 cooperate with the front and back walls 322, 326 and upper and lower ends 324, 328 to provide closure to the housing 314. Desirably, but not by way of limitation, the housing 314 may be formed to generally conform to a certain amount of dry sheets 12 and premoistened sheets 111.

The premoistened sheets 111 are dispensed from the container 119 from openings (not shown) in the container 319 and through a dispensing opening (not shown) in the housing 314. The dry sheets 12 may be dispensed from the dispensing opening 320 in the upper end 324 of the housing 314, as illustrated in FIG. 13–16. The premoistened sheets 111 may be dispensed from the front wall 322 of the dispenser 310 via a resealable cover 170.

As shown in FIGS. 13 and 15, the resealable cover 170 may be positioned over the dispensing opening (not shown) in the housing 314 which is aligned with the opening (not shown) in the container 319 of premoistened sheets 111. The premoistened sheets 111 are then accessed through the resealable cover 170 to permit dispensing of the premoistened sheets 111 from the dispenser 310. Alternatively, or, in addition thereto, the container may also include a resealable cover which is aligned with the dispensing opening of the housing to permit access to the premoistened sheets as well (not shown).

In a non-limiting example of one possible resealable cover 170, FIGS. 13 and 15 disclose a resealabe cover 170 which includes an upper flap 172 which is coupled to a portion of a lower flap 174, which has an opening or slit 176 therein, through which the premoistened sheets 111 are withdrawn. The upper flap 172 releasably engages the lower flap 174 as previously described; other resealable mechanisms may also be used.

As illustrated in FIG. 16, the housing 314 desirably is an integral unit such that one compartment contains the dry sheets 12 and the container 319 of premoistened sheets 111. However, alternatively, the housing 114 may include first and second compartments formed separately, or other alternatives disclosed herein.

The premoistened sheets 111 may be encased in a liquid impermeable film, and this film may provide a portion, or all, of the container 319 as shown in FIG. 16. In a further example, the container 319 may be formed from at least one other material, and the container 319 may be lined with the film (not shown).

When the dispenser 310 is used to dispense dry sheets 12 and premoistened sheets 111 from various generally horizontal surfaces 32 (FIG. 13), the dispenser 310 is positioned, as described previously, such that the front wall 322 and the resealable cover 170 thereon from which the premoistened sheets 111 are dispensed is desirably disposed in a superior or higher position. The dispensing opening 320 from which the dry sheets 12 are dispensed is desirably positioned in an inferior or lower position. It will be appreciated that these positions may be reversed, with no detrimental effects to the dispenser 310, the premoistened sheets 111, or the dry sheets 12. Either of these positions permits dispensing of dry sheets 12 or premoistened sheets 111 for use, for example, as facial tissue sheets, wet wiping sheets, and so forth. However, when it is desired to use the dispenser 310 to dispense the dry sheets 12 and/or the premoistened sheets 111 for use as bath or toilet tissue, the dispenser 310 easily adapts by converting from a table top dispenser to a dispenser which couples to a conventional rolled product fixture for dispensing sheets for use as bath or toilet tissue.

The dispenser 310, as shown in FIGS. 14–16, has a hanging port 334 which is provided on a lower end 328 of the housing 114, as described previously herein. When the housing 314 is suspended from the roll mount 44 and the fixture 46, it is suspended in a manner which is identical to that described previously. The hanging port 334 is provided on a lower end 328 and it has two sides 380, 381 which provide a center apex 382. Two opposing and generally triangular-shaped sides 384 are positioned adjacent side walls 330. Perforations 336 formed in the triangular-shaped sides 384 may be opened into openings 338 through which the roll mount extends to secure the housing 314 to the fixture 46. Therefore, when extended from a fixture 46 it will be understood that the housing 314 may be positioned such that an axis 362 is parallel to the vertical support surface. Alternatively, the axis 362 may be non-parallel, depending upon the angle desired for ease in dispensing both the dry sheets 12 and the premoistened sheets 111, and the axis 362 may extend at an oblique angle relative to the vertical support surface 52.

In the present embodiment, when the dispenser 310 is suspended from the roll mount 44 and fixture 46 as shown in FIG. 15, the dry sheets 12 on the upper end 324 of the dispenser 310 are desirably positioned in a lower, inferior position, relative to the premoistened sheet 111, which are desirably positioned in a superior or higher position.

The dispenser 310 and the housing 314 include width, length, and depth dimensions 60, 64, 66, respectively. These dimensions are desirably the same as those previously described for dispenser 10 and housing 14 (FIG. 3). In addition, it will be appreciated that the dispenser 310 and the housing 314 may include any features and/or characteristics shown and/or described herein for any dispenser and housing.

Figure 17:
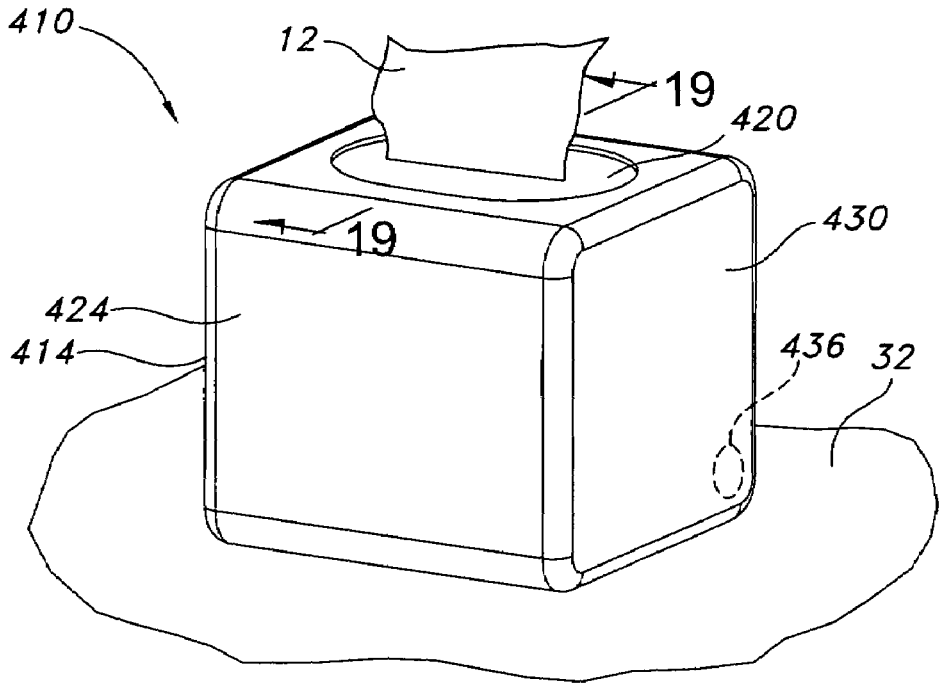
FIG. 17 is a perspective view of a further embodiment of the dispenser of the present invention, showing the dispenser in its dispensing position on a substantially horizontal surface for dispensing dry sheets therefrom.
Figure 18:
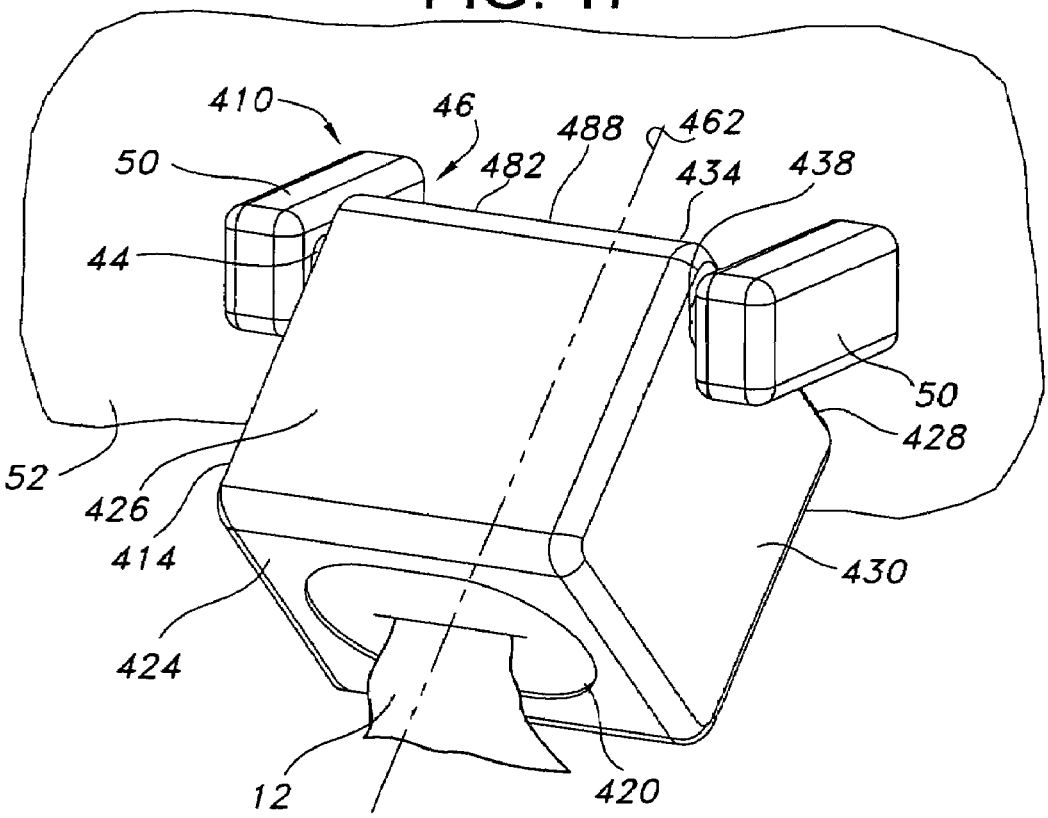
FIG. 18 is perspective view of the dispenser of FIG. 17, but showing the dispenser in its dispensing position for dispensing dry sheets when hung by its hanging port from a roll mount of a conventional rolled product fixture.
Figure 19:
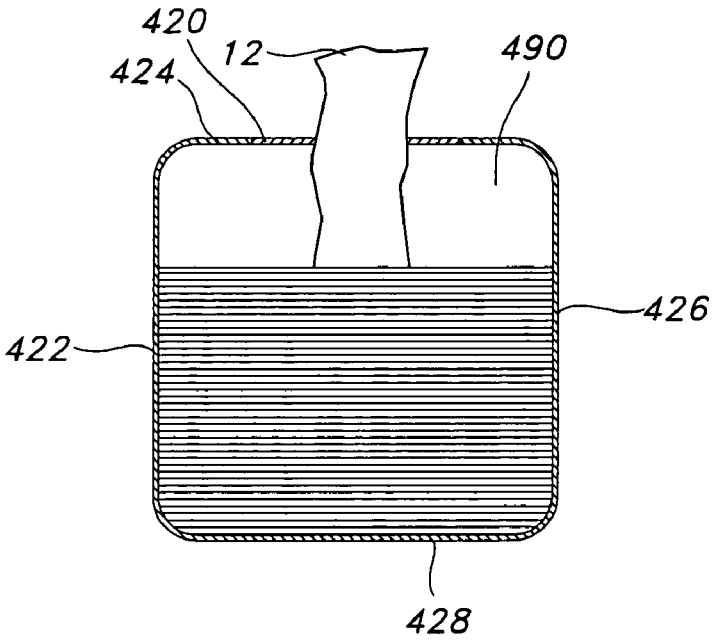
FIG. 19 is a sectional view of FIG. 17 taken along line 19—19.
Figure 20:
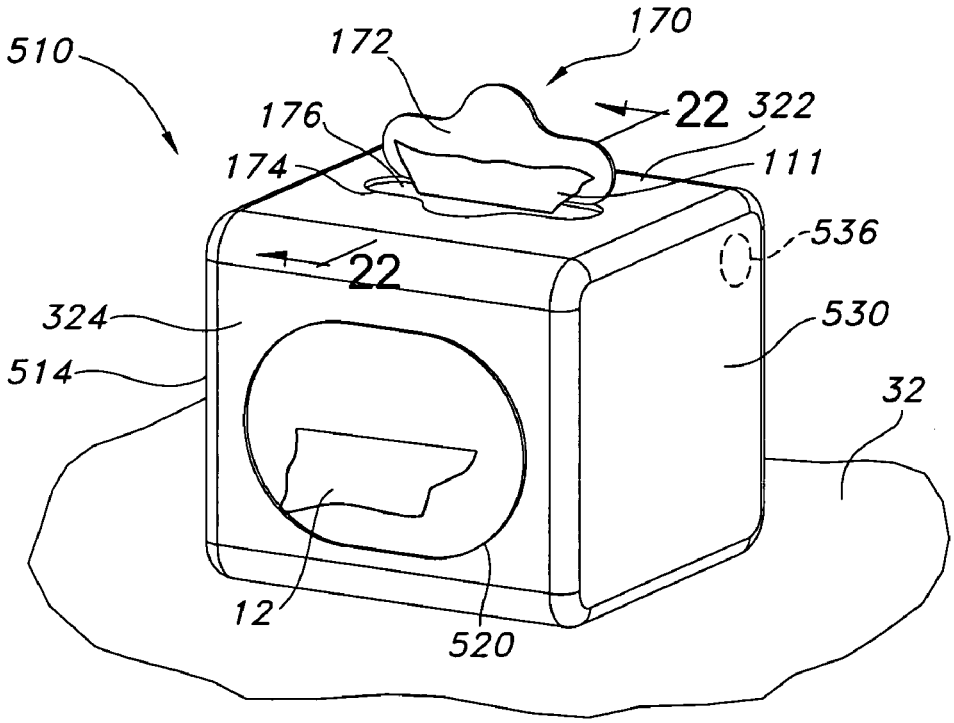
FIG. 20 is yet a further embodiment of a dispenser of the present invention, showing the dispenser in its dispensing position on a substantially horizontal surface for dispensing either dry sheets or premoistened sheets therefrom.
Figure 21:
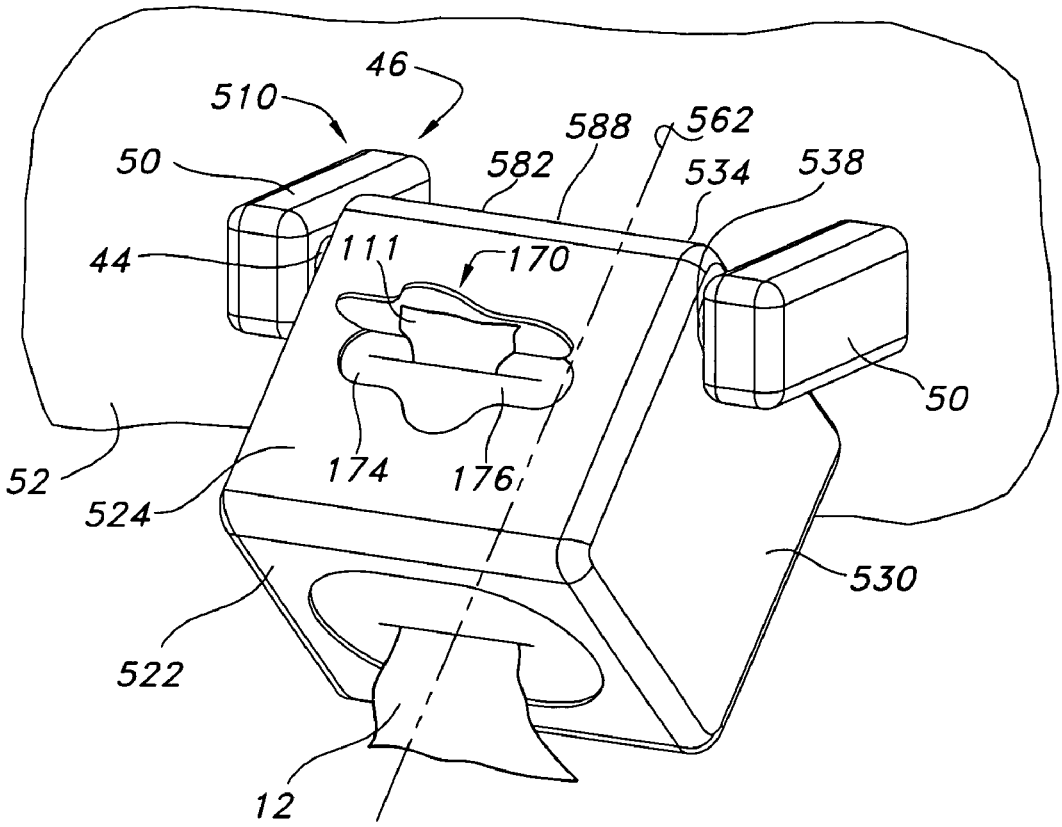
FIG. 21 is a perspective view of the dispenser of FIG. 20, but showing the dispenser in its dispensing position for dispensing dry sheets and premoistened sheets when hung by its hanging port from a roll mount of a conventional rolled product fixture.
Figure 22:
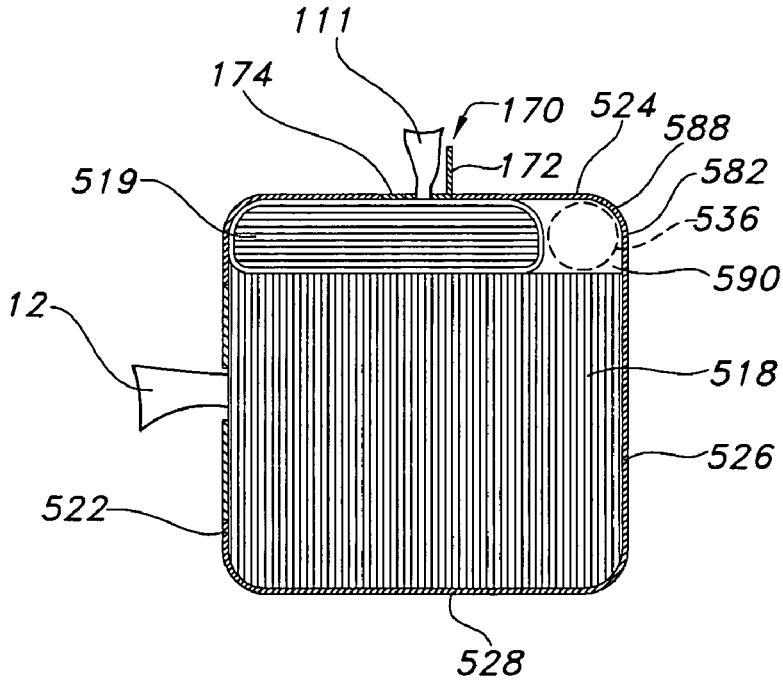
FIG. 22 is a sectional view of FIG. 20 taken along line 22—22.

Turning now to two other embodiments of the invention, FIGS. 17–19 disclose a dispenser containing dry sheets. The dispenser may be used to dispense sheets from a table top for use as facial tissue sheets. The dispenser also has a hanging port provided at a junction of two structures or walls. The dispenser may be placed on a table top, or releasably coupled via the hanging port to a conventional rolled product fixture to provide dry sheets for bath or toilet tissue. The dispenser shown in FIGS. 20–22 is similar to the previous dispenser, but dispenses premoistened sheets as well as dry sheets.

Turning now to FIGS. 17–19, a dispenser 410 according to the invention is provided for desirably, but not by way of limitation, dispensing dry sheets 12. The dispenser 410 and housing 414 is similar to the dispenser 10, 210 and housing 14, 214 previously shown and described in detail herein.

The dispenser 410 includes a housing 414 which has a compartment 418 (FIG. 19) in which dry sheets 12 are stored and dispensed therefrom. A dispensing opening 420 is defined in the housing 414 to permit access to the compartment 418 and the dry sheets 12 therein. The dispensing opening 420 desirably is provided by way of non-limiting example in an upper end 424.

The housing 214 includes, as shown in FIGS. 17 and 19, front and back walls 422, 426 and upper and lower ends 424, 428. A pair of sidewalls 430 cooperate with the front and back walls 422, 426 and upper and lower ends 424, 428 to provide the housing 414. Desirably, but not by way of limitation, the housing 414 may be formed to generally conform to a certain amount of dry sheets 12 provided in the housing 414, as described previously.

The dispenser 410 is used to dispense dry sheets 12 from a generally horizontal surface 32, such as, for example, a table top, and so forth. When the dispenser 410 is positioned on such a horizontal surface 32, the structure, namely the wall or end having the dispensing opening 420 therein, such as the upper end 424, is desirably disposed in a superior or higher position, as shown in FIG. 17. It will be appreciated, however, that any position may be used to dispense dry sheets 12, such as tissue sheets used as facial tissue, and so forth, from a horizontal surface 32 such as a table top. The present dispenser 410 also is suitable for dispensing dry sheets 12 for use as bath or toilet tissue, and easily adapts to this task, converting from a table top dispenser to a dispenser which couples to a conventional rolled product fixture for dispensing sheets for use as bath or toilet tissue.

As shown in FIG. 18, the dispenser 410 desirably provides a hanging port 434. The hanging port 434 in the present embodiment is formed at a junction of two walls or structures, such as, in the present example, the junction 488 of the back wall 420 and the lower end 428, via perforations 436 formed adjacent the junction 488 in the side walls 430 which can be opened into a pair of openings 438. Alternatively, the openings are covered by a seal or a release sheet (not shown). The junction 488 provides an upper apex 482 of the dispenser 410. The back wall 426 and the lower end 428 are then positioned above or superior to the upper end 424 and the front wall 422. The dispensing opening 420 is provided at an angle relative to the vertical support surface 52.

Adequate space 490 is provided in the housing 414 to permit the roll mount 44 to be positioned through the openings 438 and coupled to a conventional rolled product fixture 46 (FIG. 19). The space 490 permits the sheets 12 to move when the dispenser 410 is rotated to place the roll mount 44 therethrough. This design yet again masks the hanging port 434 when it is in a position on a table top, thereby effectively hiding the purpose of the hanging port 434 prior to its use. When the dispenser 410 is desired for use as a dispenser for toilet tissue, the perforations 436 are opened into openings 438 and the roll mount 44 is disposed therethrough to permit the dispenser 410 to be coupled to the rolled product fixture 46.

The dispenser 410 shown in FIG. 18 is positioned such that it is suspended at an angle from the roll mount 44 and the fixture 46. The dispenser 410 is provided in an aesthetic proportion relative to the fixture 46, and includes the width, length and depth dimensions 60, 64, 66 described previously herein. The hanging port 434 is desirably, but not by way of limitation, integrally provided with the housing 14.

An axis 462 may be positioned vertically through the apex 482 of the hanging port 434; in one embodiment, the axis 462 is also positioned substantially parallel to the generally vertical support surface 52. It will be appreciated, however, that the dispenser 410 may be off-set relative to the vertical support surface 52, so that the axis 462 is not parallel to the vertical support surface 52, and the dispenser is positioned at an oblique angle relative to the vertical support surface 52. The position of the dispenser 410 when it is coupled to the fixture 46 is based on the location of the dispensing opening 420 and the angle which provides easiest access to the dry sheets 12.

The housing 414 may desirably be non-refillable, and when the dry sheets 12 are removed, the dispenser 10 is disposed of. However, the housing may be refillable, as previously described herein. The dispenser 414 may be formed from any material(s) described herein, and contain any feature from any embodiment shown and/or described herein.

In another embodiment of the invention, as illustrated in FIGS. 20–22, the dispenser 510 and housing 514 are very similar to the dispenser 410 and the housing 412 shown in FIGS. 17–19, and previously described in detail herein. The dispenser 510, however, is adapted to provide premoistened sheets 111 as well as dry sheets 12 from a single housing 514. The compartment 518 contains a plurality of dry sheets 12. The compartment 518 also includes a container 519 of premoistened sheets 111 as well. The container 519 of premoistened sheets 111, as illustrated in FIG. 22, may be provided as a separate container. Alternatively, however, the container 519 of premoistened sheets 111 may be provided as a portion of a cartridge which includes dry sheets 12 (not shown).

The housing 510, similar to the housing 410, includes front and back walls 522, 526 and upper and lower ends 524, 528. Sidewalls 530 cooperate with the front and back walls 522, 526 and upper and lower ends 524, 528 to provide closure to the housing 514, as shown in FIGS. 20 and 22. Desirably, but not by way of limitation, the housing 514 may be formed to generally conform to a certain amount of dry sheets 12 and premoistened sheets 111.

The premoistened sheets 111 are dispensed from the container 519 from openings (not shown) in the container 519 and through a dispensing opening (not shown) in the housing 514. The dry sheets 12 may be dispensed from the dispensing opening 520 in the front wall 522 of the housing 514, as illustrated in FIGS. 20–22. The premoistened sheets 111 may be dispensed from the upper end 524 of the dispenser 510 via a resealable cover 170. The dispenser 510 in this embodiment may be positioned such that the upper end 524 is positioned in a higher or more superior position relative to the front wall 522, which is positioned in a lower position or more inferior position, when positioned on a table top or horizontal surface 32.

As shown in FIGS. 20 and 21, the resealable cover 170 may be positioned over the dispensing opening (not shown) in the housing 514 which is aligned with the opening (not shown) in the container 519 of premoistened sheets 111. The premoistened sheets 111 are then accessed through the resealable cover 170 to permit dispensing of the premoistened sheets 111 from the dispenser 510. Alternatively, or, in addition thereto, the container 519 may also include a resealable cover 170 which is aligned with the dispensing opening of the housing 514 to permit access to the premoistened sheets 111 as well (not shown). The resealable cover 170 of the present embodiment includes an upper flap 172 which is coupled to a portion of a lower flap 174, which has an opening or slit 176 therein, through which the premoistened sheets 111 are withdrawn. The upper flap 172 releasably engages the lower flap 174 as previously described; other resealable mechanisms may also be used.

As illustrated in FIGS. 21 and 22, the housing 514 desirably is an integral unit such that one compartment contains the dry sheets 12 and the container 519 of premoistened sheets 111. However, alternatively, the housing 514 may include first and second compartments formed separately, or other alternatives disclosed herein.

The premoistened sheets 111 may be encased in a liquid impermeable film, and this film may provide a portion, or all, of the container 519 as shown in FIG. 22, where space 590 is provided for a roll mount 44 to extend therethrough. In a further example, the container 519 may be formed from at least one other material, and the container 519 may be lined with the film (not shown).

When the dispenser 510 is used to dispense dry sheets 12 and premoistened sheets 111 from various generally horizontal surfaces 32 (FIG. 20), the dispenser 310 is positioned, as described previously. It will be appreciated that the position may be reversed, with no detrimental effects to the dispenser 510, the premoistened sheets 111, or the dry sheets 12. Either of these positions permits dispensing of dry sheets 12 or premoistened sheets 111 for use, for example, as facial tissue sheets, wet wiping sheets, and so forth. However, when it is desired to use the dispenser 510 to dispense the dry sheets 12 and/or the premoistened sheets 111 for use as bath or toilet tissue, the dispenser 510 adapts easily by converting from a table top dispenser to a dispenser which couples to a conventional rolled product fixture for dispensing sheets for use as bath or toilet tissue.

The dispenser 510, as shown in FIG. 21, is suspended from its hanging port 534, as described previously herein. The hanging port 554 is formed at the junction 588 of the upper end 524 and the back wall 526 via perforations 536 formed adjacent the junction 588 in the side walls 530 which may be opened into openings 438. The junction 588 provides an upper apex 582 of the dispenser 510. The upper end 524 and the back wall 536 are positioned above or superior to the front wall 522 and the lower end 528, when the dispenser 510 is coupled to the fixture 46 (FIG. 21). It will be appreciated that both the premoistened sheets 111 and the dry sheets 12 are dispensed at an angle relative to the vertical support surface 52. Therefore, it will also be appreciated that the housing 514 may be positioned such that an axis 562 is parallel to the vertical support surface 52. Alternatively, the axis 562 may be non-parallel, depending upon the angle desired for ease in dispensing both the dry sheets 12 and the premoistened sheets 111. When non-parallel, the dispenser 510 is positioned at an oblique angle relative to the vertical support surface 52.

In the present embodiment, when the dispenser 510 is suspended from the roll mount 44 and fixture 46, the dry sheets 12 are positioned at an oblique angle relative to the vertical support surface 52 and are desirably positioned in a lower, inferior position, relative to the premoistened sheet 111, which are desirably positioned at an oblique angle relative to the vertical support surface 52 in a superior or higher position.

The dispenser 510 and the housing 514 include width, length, and depth dimensions 60, 64, 66, respectively. These dimensions are desirably the same as those previously described for dispenser 10 and housing 14 (FIG. 3). In addition, it will be appreciated that the dispenser 510 and the housing 514 may include any features and/or characteristics shown and/or described herein for any dispenser and housing.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A non-refillable dispenser adapted for dispensing from a table top and convertible to dispensing from a conventional rolled product fixture, the non-refillable dispenser comprising:

a housing formed from a plurality of walls which cooperate with an upper end and a lower end to provide the housing and a compartment therein to hold sheets, and a dispensing opening for removal of sheets formed in at least one portion of the housing, the housing designed to be positioned on a table top for dispensing sheets therefrom, the housing including connecting means formed in at least one end of the housing, the end including two spaced-apart areas of perforations which, when opened, provide a pair of spaced-apart openings, one portion of the end configured to be flexible such that the portion of the end flexes to permit the housing to be coupled to a fixture while at least one other portion of the end remains in its original position perpendicular to an adjacent wall, the connecting means masked as a portion of the housing when the dispenser is positioned on a table top for dispensing, the connecting means easily un-masked when the perforations are opened to provide the pair of spaced-apart openings to permit the housing to be releasably coupled to a fixture.

2. The non-refillable dispenser of claim 1, wherein the housing is constructed from a material which includes paperboard.

3. The non-refillable dispenser of claim 1, wherein the housing is constructed from a material which includes polymer film.

4. The non-refillable dispenser of claim 1, wherein the sheets include dry sheets.

5. The non-refillable dispenser of claim 1, wherein the dry sheets are toilet tissue.

6. The non-refillable dispenser of claim 1, wherein the compartment includes dry sheets and a container of premoistened sheets.

7. The non-refillable dispenser of claim 1, wherein the housing includes a resealable cover.

8. The non-refillable dispenser of claim 1, wherein the housing is constructed from a material which includes cellophane.

9. A non-refillable dispenser adapted for dispensing from a table top and convertible to dispensing from a conventional rolled product fixture, the non-refillable dispenser comprising:

a housing formed from a plurality of walls which cooperate with an upper end and a lower end to provide the housing and a compartment therein to hold sheets, and a dispensing opening for removal of sheets from the housing, the housing designed to be positioned on a table top for dispensing sheets therefrom, the housing including two spaced-apart areas of perforations formed in one end of the housing which, when opened, provide a pair of spaced-apart openings, one portion of the end configured to be flexible such that the portion of the end flexes to permit the housing to be coupled to a fixture while at least one other portion of the end remains in its original position perpendicular to an adjacent wall, the purpose for the perforations masked when the dispenser is positioned on a table top for dispensing, the purpose for the perforations unmasked when the perforations are opened to provide the pair of spaced-apart openings to permit the housing to be releasably coupled to a fixture in a bathroom.

10. The non-refillable dispenser of claim 9, wherein the housing is constructed from a material which includes paperboard.

11. The non-refillable dispenser of claim 9, wherein the housing is constructed from a material which includes polymer film.

12. The non-refillable dispenser of claim 9, wherein the sheets include dry sheets.

13. The non-refillable dispenser of claim 9, wherein the dry sheets are toilet tissue.

14. The non-refillable dispenser of claim 9, wherein the compartment includes dry sheets and a container of premoistened sheets.

15. The non-refillable dispenser of claim 9, wherein the housing includes a resealable cover.

16. The non-refillable dispenser of claim 9, wherein the housing is constructed from a material which includes cellophane.

17. A non-refillable dispenser adapted for dispensing from a table top and convertible to dispensing from a conventional roiled product fixture in a bathroom, the non-refillable dispenser comprising:

a housing formed from a plurality of walls which cooperate to provide the housing and a compartment therein to hold sheets at least one dispensing opening for removal of sheets formed in at least one portion of the housings, the housing designed to be positioned on a table top for dispensing sheets therefrom, the housing including two spaced-apart areas of perforations formed in spaced-apart parallel walls of the housing which, when opened, provide a pair of spaced-apart openings which permit a portion of a fixture to be positioned throucih the openings in the walls and into at least a portion of the compartment of the housing to couple the housing to a fixture, the purpose for the perforations masked when the dispenser is positioned on a table top for dispensing, the purpose for the perforations unmasked when the perforations are opened to provide the pair of spaced-apart openings to permit the housing to be releasably coupled to a fixture in a bathroom for dispensing sheets therefrom, and wherein at least one wall of the housing is disposed at an oblique angle relative to a vertical support surface when coupled to a fixture.

18. The non-refillable dispenser of claim 17, wherein the housing is constructed from a material which includes paperboard.

19. The non-refillable dispenser of claim 17, wherein the housing is constructed from a material which includes polymer film.

20. The non-refillable dispenser of claim 17, wherein the housing includes a resealable cover.

21. The non-refillable dispenser of claim 17, wherein the housing is constructed from a material which includes cellophane.

22. A non-refillable dispenser adapted for dispensing from a table top and convertible to dispensing from a conventional rolled product fixture, the non-refillable dispenser comprising:

a housing formed to include a compartment to hold sheets therein and a dispensing opening for removal of sheets from the housing, the housing designed to be positioned on a table top for dispensing sheets therefrom, the housing comprising an excess of material on one portion of the housing, the excess of material folded against an outer surface of the housing when the dispenser is positioned on a table top, the excess of material releasable such that it forms a tent-shaped configuration having two opposing generally triangular sides, and wherein each triangular side includes one area of perforations which, when opened, provide a pair of spaced-apart openings which permit the housing to be coupled to a fixture, the purpose for the perforations masked when the dispenser is positioned on a table top for dispensing and the excess of material is folded against the outer surface of the housing, the purpose for the perforations unmasked when the excess of material is released and the perforations are opened to provide the pair of spaced-apart openings for releasably coupling the housing to a fixture in a bathroom to dispense sheets therefrom.

23. The non-refillable dispenser of claim 22, wherein at least one wall of the housing is positioned substantially parallel to a vertical support surface when coupled to a fixture.

24. A non-refillable dispenser adapted for dispensing from a table top and convertible to dispensing from a conventional rolled product fixture in a bathroom, the non-refillable dispenser comprising:

a housing formed to include a compartment to hold dry sheets and a container of premoistened sheets, and dispensing openings positioned in the housing to permit each of the dry sheets and the premoistened sheets to be dispensed from the housing, the housing comprising an excess of material on one portion of the housing, me excess of material folded against an outer surface of the housing when the dispenser is positioned on a table top, the excess of material releasable such that it forms a tent-shaped configuration having two opposing generally triangular sides, and wherein each triangular side includes one area of perforations which, when opened, provide a pair of spaced-apart openings which permit the housing to be coupled to a fixture, the purpose for me perforations masked when the dispenser is positioned on a table top for dispensing and the excess of material is folded against the outer surface of the housing, the purpose for the perforations unmasked when the excess of material is released and the perforations are opened to provide the pair of spaced-apart openings for releasabty coupling the housing to a fixture in a bathroom to dispense sheets therefrom.

25. The non-refillable dispenser of claim 24, wherein at least one wall of the housing is positioned substantially parallel to a vertical support surface when coupled to a fixture.

* * * * *